US010309390B2

(12) United States Patent
Zavadinka et al.

(10) Patent No.: US 10,309,390 B2
(45) Date of Patent: Jun. 4, 2019

(54) CONTROL UNIT FOR HYDRAULIC VARIABLE DISPLACEMENT PUMPS AND VARIABLE DISPLACEMENT PUMP WITH A CONTROL UNIT

(71) Applicant: Danfoss Power Solutions Inc., Ames, IA (US)

(72) Inventors: Peter Zavadinka, Chocholna-Velcice (SK); Stanislov Smolka, Provazska (SK); Pavol Sedo, Dubnica nad Vahom (SK)

(73) Assignee: Danfoss Power Solutions A.S., Povazska Bystrica (SK)

( * ) Notice: Subject to any disclaimer, the term of this patent is extended or adjusted under 35 U.S.C. 154(b) by 551 days.

(21) Appl. No.: 14/452,112

(22) Filed: Aug. 5, 2014

(65) Prior Publication Data

US 2015/0050165 A1 Feb. 19, 2015

(30) Foreign Application Priority Data

Aug. 19, 2013 (DE) ..... 10 2013 216 395

(51) Int. Cl.
*F04B 1/32* (2006.01)
*F04B 49/00* (2006.01)
(Continued)

(52) U.S. Cl.
CPC ..... *F04B 49/08* (2013.01); *F04B 1/324* (2013.01); *F04B 49/002* (2013.01); *F04B 49/12* (2013.01); *Y10T 137/86622* (2015.04)

(58) Field of Classification Search
CPC ..... F04B 1/32; F04B 1/324; F04B 1/2078; F04B 49/22; F04B 49/08; F04B 49/12; F04B 49/125; Y10T 137/86622
(Continued)

(56) References Cited

U.S. PATENT DOCUMENTS 3,286,601 A * 11/1966 Jones ..... F04B 1/324 137/109
4,456,434 A * 6/1984 El Ibiary ..... F04B 1/324 137/625.65

(Continued)

FOREIGN PATENT DOCUMENTS

DE 19538649 A1 4/1997
DE 19949169 A1 4/2001

*Primary Examiner* — Philip E Stimpert
(74) *Attorney, Agent, or Firm* — Zarley Law Firm, P.L.C.

(57) ABSTRACT

Control device for hydraulic variable displacement pumps operated in an open hydraulic circuit and adjustable in their displacement volume by means of a servo control device. The control device comprises a control piston with two control edges to which pressure can be applied by means of pressurized pressure fluid from a variable displacement pump, the control piston being mounted in a housing so that it shifts longitudinally. The housing of the control piston comprises an inlet for the connection of a high pressure line of a variable displacement pump, an outlet which can be connected to a tank and a servo connection which can be linked to a servo cylinder, whereby a link between the inlet and the servo connection can be made via a first control edge. It is possible to create a link between the servo connection and the outlet via a second control edge.

19 Claims, 4 Drawing Sheets

(51) Int. Cl.
*F04B 49/08* (2006.01)
*F04B 49/12* (2006.01)

(58) Field of Classification Search
USPC ..... 417/270; 137/625.65
See application file for complete search history.

(56) References Cited

U.S. PATENT DOCUMENTS 5,284,220 A * 2/1994 Shimizu ..... F15B 13/0402
137/330
5,702,235 A * 12/1997 Hirota ..... F04B 27/1804
417/222.2
2010/0320406 A1* 12/2010 Matsuo ..... G05D 7/0635
251/129.01

* cited by examiner

CONTROL UNIT FOR HYDRAULIC VARIABLE DISPLACEMENT PUMPS AND VARIABLE DISPLACEMENT PUMP WITH A CONTROL UNIT

BACKGROUND OF THE INVENTION

The invention concerns a control device for hydraulic variable displacement pumps which are adjustable on one side according to the generic concept of claim 1 and a variable displacement pump fitted with such a control device according to claim 10. In particular, the invention concerns hydraulic variable displacement pumps which are operated in an open hydraulic circuit and which are adjustable by means of a servo piston that can shift inside a servo cylinder, to which, in turn, pressure can be applied via a control device by means of pressurized pressure fluid. For this purpose, the servo piston acts on a displaceable adjustment element or transmission component, for example the swash plate or the bent axis, thereby adjusting the angular position of the latter and thus also the displacement volume of the variable displacement pump according to the position of the control piston in the control device. The variable displacement pump is preferably configured as an axial piston machine in swash plate or bent axis design, whereby the inventive concept can also be applied to radial piston pumps or vane pumps insofar as the latter are adjustable in their pump pressure via a servo control unit.

The invention is described based on variable displacement pumps that are adjustable on one side by means of a servo control unit, such pumps demonstrating maximum flow rate when the servo control unit is set to zero pressure or power. However, the inventive concept also covers the reverse construction of this type of variable displacement pump, in other words also variable displacement pumps which demonstrate minimum flow rate, i.e. are deflected to a minimum extent, when the servo control unit is set to zero power. If the servo control unit does not exert any force on the displacement volume adjustment element, the variable displacement pumps used as examples to explain the inventive concept are moved into a position of maximum deflection, usually by means of internal springs or similar which act on the adjustment element. This means that when the servo control unit applies a force to the adjustment element of the variable displacement pump, the latter is deflected out of its maximum position in the direction of reduced output. In the case of minimum flow rate, i.e. minimum high pressure, the variable adjustment pump is set to a minimum deflection angle. The servo control unit then exerts a maximum force on the adjustment element of the variable displacement pump, for example a swash plate or a bent axis.

A control device for such variable displacement pumps is familiar from DE 199 49 169 A1. This document describes a variable displacement pump configured as an axial piston pump with a deflectable swash plate and operated in an open hydraulic circuit. The adjustment device for the angular position of the swash plate comprises a servo piston which shifts inside a servo cylinder to which pressure can be applied via pressurized liquid by means of a control device, the control device being safeguarded by means of an additional pressure control valve in order to limit maximum operating pressure. The control device comprises a control piston with two control edges that is mounted in a housing so that it shifts longitudinally. The housing of the control piston comprises an inlet for fluid under high pressure from the variable displacement pump, an outlet which can be connected to a tank and a hydraulic connection that is linked to an inlet of the servo cylinder. A link can be created between the inlet and the connection via a first control edge, and a second control edge can be used to create a link between the connection to the servo cylinder and the outlet to the tank. The control device according to DE 199 49 169 A1 is complex in structure and comprises a large number of elements including several springs and a solenoid which acts directly on the servo piston.

A disadvantage in the control device shown in DE 199 49 169 A1 is that it requires a large number of components and an additional, elaborate pressure control valve placed between the outlet to the tank and the housing of the control piston, and that the control piston and servo piston interact via a spring. In addition, it involves adjustment of the neutral position of the servo piston via an eccentrically mounted disc which forms an end stop for a valve sleeve.

In DE 195 38 649 A1 a pump regulation valve is controlled by means of double-sided application of hydraulic pressure to the control piston. Here a pressure upstream of a consumer directional valve exerted on a first side of the control piston acts against a pressure tapped downstream of the consumer directional valve which is exerted on a second side of the control piston. The displacement volume of the variable displacement pump is set based on the different in pressure in the connection lines by means of a setting device.

The invention is therefore based on achieving the object of creating a control device for hydraulic variable displacement pumps adjustable on one side of the type described above which are simple and robust in construction and easily adjustable. The control device according to the invention shall make do with a small number of components and allow an even increase and decrease in the flow rate of the variable displacement pump during operation while still retaining load-dependent power regulation of the variable displacement pump. It should be possible to set various power levels for the variable displacement pump which can be reliably maintained by the automatically regulating control device according to the invention without requiring any external control intervention. In addition, the control device according to the invention should not require additional pressure control valves in order to limit maximum high pressure.

SUMMARY OF THE INVENTION

This object is achieved according to the characterizing portion of claim 1 in that the control piston of the control unit at a first end adjacent to the inlet is preloaded by a first spring and subject to high pressure from pressure fluid supplied by a variable displacement pump to create a hydraulic force such that the control piston can shift towards the opposite, second end of the control piston adjacent to the outlet. At the second end of the control piston, a second spring engages which counteracts the hydraulic force and the preload of the first spring. In addition, an actuator is placed at one of the two ends of the control piston which can be controlled by a control unit, the actuator serving to transfer a tractive or compressive force to the end of the control piston at which the actuator is positioned.

In this way, the mounting of the control piston by means of the two springs enables output levels to be set via the actuator which are automatically controlled in a load-dependent manner by the high pressure of the variable displacement pump. For example, if the first spring on the high-pressure/inlet side of the control piston together with the high pressure generates a greater force than the second spring on the outlet side of the control piston, and the actuator is set to zero power, the control piston is moved into a position of maximum deflection on the outlet side which corresponds to the minimum output of the variable displacement pump. In this position, a hydraulic connection between the high pressure inlet and the servo control device is opened to maximum extent.

If, inversely, the second spring on the outlet side of the control piston is more powerful than the combination of the hydraulic force acting on the control piston and the first spring positioned on the first outlet side, the control piston—once again with the actuator set to zero power—will likewise be in a position of maximum deflection, though this corresponds to the position of maximum output of the variable displacement pump. In this position, the hydraulic connection between the high pressure inlet and the servo control unit is closed and the pressure in the servo cylinder can be relieved via the outlet opening in the control housing.

If a tractive or compressive force is applied to the control piston via the actuator—depending on whether it is positioned adjacent to the inlet side or outlet side and depending on how the spring strengths have been selected for the first spring on the high pressure side and for the second spring on the outlet side of the control piston—a new balance of forces is established that corresponds to a flow rate of the variable displacement pump deviating from both its maximum and its minimum flow rate.

As set out above, the invention is based on variable displacement pumps which are not reversible, i.e. pumps that can only be swiveled on one side and can therefore only be pivoted from a minimum displacement volume to a maximum displacement volume when the same direction of flow is maintained. The types of hydraulic pump relating to the invention do not allow for a reversal of the rotational direction or direction of flow. An example of a potential application for this type of hydraulic or variable displacement pump is a feed pump for a closed hydraulic circuit, for instance in a hydrostatic transmission or drive. If the control device according to the invention is duplicated as appropriate, however, double-sided variable displacement pumps, comprising a servo piston to which pressure can be apply from two sides, can be set to an output level in a controlled manner by two control devices according to the invention. At such an output level, reversible hydraulic pumps can be regulated automatically by the two control devices according to the invention on a load-dependent basis. The inventive concept therefore also covers such duplication of the control device according to the invention.

Based on an actuator force equal to zero, the control device according to the invention can essentially be used, as the power of the actuator increases, to control two response patterns in a hydrostatic unit adjustable on one side: i) increase of the flow rate and ii) decrease of the flow rate. Conversely, it is also possible to control the response patterns if the actuator force is reduced in a controlled manner. However, in order to simplify the explanation of the invention in the following, a starting position of the variable displacement pump will always be assumed at which the actuator is inactive, i.e. the actuator force is equal to zero. In these starting positions, the variable displacement pump is either at maximum or minimum flow rate, depending which end of the control piston is shifted into maximum position. If the control piston is shifted to maximum position on the inlet side, the hydraulic link between the high pressure inlet and the hydraulic connection is blocked to the servo control, while at the same time the outlet in the control housing is open to pressure fluid coming from the servo control device. This means that no servo force is applied to the servo piston and the variable displacement pump is at maximum deflection as is inherent to its design, thereby producing maximum flow rate. In the other case, if the control piston is shifted to the second, inlet side in the housing, the high pressure is passed onto the servo control to maximum extent since the relevant control edge on the control piston opens the hydraulic connection between the high pressure inlet and the hydraulic connection for the servo control, with the second control edge closing the outlet so that the pressure in the servo piston cannot be relieved. In this way, hydraulic pressure is applied to the servo piston by means of which the servo piston can exert a back-deflection force on the adjustment element of the variable displacement pump. Thus the variable displacement pump is set to its minimum flow rate when the control piston is shifted into maximum position towards the outlet side.

If the control device according to the invention is be used to decrease the flow rate, in other words if the flow rate and therefore the supply pressure of the variable displacement pump is to decrease as the actuator force increases, the force exerted by the servo piston on the adjustment element of the variable displacement pump must also increase as the actuator force increases. For this starting position—actuator force equal to zero—the second spring placed adjacent to the outlet side of the control piston is to be designed so that its spring force is greater than the combined forces on the inlet side of the control piston. In the case of such a design, the control piston is shifted fully towards the inlet side, causing the servo line connection in the control housing to be hydraulically linked to the tank and the force applied to the servo piston to be at zero or almost zero. The latter force will at least be smaller than would be required to move the variable displacement pump out of its maximum deflected position. The forces on the inlet side are produced by the first spring and by the hydraulic force that acts on the control piston on the inlet side in the direction of the outlet side. The hydraulic force can be generated, for example, by means of the diameter of the control edge of the control piston facing the (high pressure) inlet being larger than the diameter of the control piston in the area of the inlet side upstream of this control edge. This type of hydraulic force can also be generated by applying high pressure to the front side of the control piston on the inlet side, for example. In this embodiment of the invention, the spring force of the second spring position on the outlet side of the control piston should preferably be capable of adjustment such that even slight forces exerted by the actuator on the control piston result in the control piston being shifted in the control cylinder towards the outlet side, with the adjustment unit reacting sensitively. However, the force of the second spring is to be selected such that the control piston can be reliably moved into the position of maximum deflection on the inlet side—when the actuator is at zero power—and/or can be maintained in this position.

Reduction of the flow rate preferably occurs proportionally to the force applied by the actuator to the control piston, which is compressive force in the case of the actuator being positioned on the inlet side for controlled reduction of flow rate as in this preferred embodiment, and a tractive force in the case of the actuator being positioned on the outlet side. In the case of both positions, a reduction in actuator force causes the control piston to be shifted in the control cylinder towards the outlet side, thereby enlarging the cross-section opening for hydraulic fluid from the variable displacement pump at the connection for the servo line in the housing as the actuator force is increased. This causes an increase in pressure in the servo cylinder and therefore also an increase in servo force. The adjustment element of the variable displacement pump is deflected back.

The preferred embodiment described above is used in many applications for a variable displacement pump which is adjustable on one side and is intended to set the variable displacement pump to maximum flow rate if an actuator force fails, which is especially desirable in the case of fan drives.

In the case of the preferred embodiment of the controlled reduction of hydraulic pressure or displacement volume, the variable displacement pump is logically set to its starting position, i.e. when the actuator is inactive, such that it generates minimum supply pressure. To this end, the control piston must be positioned in fully deflected position on the outlet side of the housing so that the cross-section for the hydraulic link between the high pressure input and the servo connection is opened to maximum extent by the relevant control edge. In this starting position, the control piston is moved into a maximum position on the outlet side by the spring force of the spring on the inlet side as well as by the hydraulic pressure of the variable displacement pump acting against the spring, and it is held in place in this position. In this way, the maximum possible pressure acts on the servo piston, which therefore returns the adjustment element on the variable displacement pump to maximum extent in the direction of zero displacement volume. Also logically, an actuator force must now be applied such that the control piston is moved from its position of maximum deflection from the outlet side of the control housing in the direction of the inlet side. This can be effected by means of an actuator on the inlet side, if this is capable of exerting a tractive force on the control piston, or else by means of an actuator on the outlet side of the control housing if this exerts a compressive force on the control piston. When the control piston is pushed towards the inlet side, the cross-section of the opening for the connection of the line to the servo control device becomes successively smaller, thereby reducing the force that can be exerted by the servo piston on the adjustment element of the variable displacement pump and increasing the deflection of the variable displacement pump as is inherent to its design, i.e. increasing its displacement volume/supply pressure. As the actuator force increases in this preferred embodiment, the supply pressure of the hydraulic pump likewise increases, preferably proportionally to the actuator force.

The control device for single-sided variable displacement pumps according to the invention thereby provides for a flexible position of the actuator, which can be placed on the side adjacent to either the inlet or the outlet of the control piston. Only the direction of the actuator force has to be taken into account so that the force generated by the actuator results in the control piston being shifted in the direction of the first or second side of the control device. This variable positioning creates flexibility in allowing for installation space specifications in a work machine, for example. At the end of the control housing opposite the actuator it is also preferable to provide an adjustment device for the spring positioned there, preferably in the form of a setting screw. Adjustment of the adjustable spring is preferably carried out in an axial direction of the spring using a setting screw that acts on one end of the spring and that is mounted in a thread located in the housing of the control piston. The adjustment device for the spring at the opposite end from the actuator allows simple, precise, effective and reliable adjustment of the starting position, also making it possible to specify the minimum force of the actuator at which the actuator force causes the control piston to shift in the control casing.

A preferred embodiment of the control device can also be configured such that the actuator is an electric solenoid to which an adjustable level of current can be applied by means of an electronic control unit. The inventive concept covers an actuator configured both to exert pressure and to apply a tractive force. The control unit comprises input elements such as sensors for pressure or other parameters relevant to the application as well as both analog and digital input aids such as adjustable potentiometers, key panels and displays. It is designed in such a way as to supply a feed current to the actuator based on the output pressure required by the variable displacement pump.

Another preferred embodiment of the invention is such that that both the first spring on the inlet side and the second spring on the outlet side are each placed adjacently in a spring chamber but outside the pressure chambers in the control housing. Furthermore, it is preferable for the two spring chambers to be connected via a through-hole so that when the control piston is shifted, pressure equalization can occur between the two spring chambers via the through-hole. In addition, one of the two spring chambers can be connected to the outlet line to the tank by means of a connection line in the housing so that this line can also bring about further pressure equalization between the spring chambers at tank pressure level. The tank pressure level can, for example, be the housing pressure level if the pressure fluid reservoir which feeds the variable displacement pump constitutes a volume integrated in the housing of the variable displacement pump.

The spring positioned on the same side of the control piston as the actuator should preferably be connected in series to the actuator, resulting in a gentler application of the actuator force to the control piston. However, the inventive concept likewise includes a parallel positioning in which a tappet of the actuator acts on the guide element of the spring, for example, which in turn rests on the control piston. It is self-evident that all types of spring may be used to execute the inventive concept which are able to provide a force in the axial direction of the control piston. Preferably, coil or disc springs should be used for both the first and the second spring, either individually or combination. For defined force transmission of the springs, it is favorable for the first and the second spring each to comprise a guide element which transmits the spring force to one end of the control piston.

BRIEF DESCRIPTION OF THE DRAWINGS

The invention will now be explained by way of an example based on preferred embodiments shown in the figures, whereby the preferred embodiments shown in the figures do not limit the inventive concept. The following are shown.

DETAILED DESCRIPTION OF THE PREFERRED EMBODIMENTS

Figure 1:
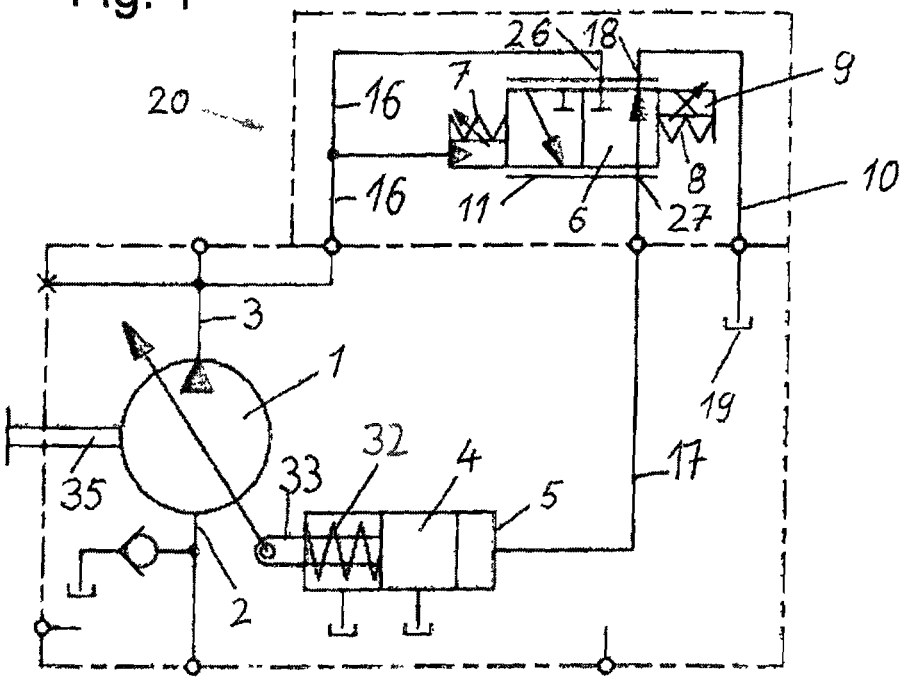
FIG. 1 A variable displacement pump with a control device according to the invention in diagrammatic form.

FIG. 1 shows a variable displacement pump 1 with a control device 20 according to the invention in diagrammatic form. The type of the variable displacement pump 1 is optional, providing that the adjustment of the displacement volume can be controlled by means of an adjustment element that can be activated by a servo piston 4.

Preferred examples here are axial piston pumps with an adjustable swash plate whose angular position can be specified by means of a servo piston 4. The variable displacement pump 1 is powered by a drive shaft 35 with a drive motor not shown here operating at a constant rotational speed, for example, and it displaces pressure fluid in an open circuit. The variable displacement pump comprises and inlet 2 and an outlet 3 for the pressure fluid and is connected to a consumer not shown here via pressure lines, as well as being connected to the control device 20 via a pressure line 16 and to a tank 19 for the pressure fluid via a drain line 10.

The control device 20 comprises a control piston 6 which is mounted in a housing 11 so that it shifts longitudinally. A first end 28 of the control piston 6 is exposed to high pressure at the outlet 3 of the variable displacement pump 1. The high pressure exerts a hydraulic force in the direction of the second end 29 of the control piston 6. The first end 28 of the control piston 6 is also in contact with an adjustable first spring 7. Pressure is applied to the opposite, second end 29 of the control piston 6 by a second spring 8 with which an actuator 9 is arranged in parallel in this exemplary preferred embodiment. Parallel here means that the force of the actuator 9 is applied to the control piston 6 independently of the second spring 8. In the case of the arrangement of the spring 8 and actuator 9 in series, as shown for example in FIGS. 3 and 4, the force of the actuator 9 is transmitted via the second spring 8 onto the second end 29 of the control piston 6. In this embodiment of the invention it is immaterial whether the second spring 8 is placed upstream or downstream of the moving part of the actuator 9.

The housing 11 of the control device 20 comprises an inlet 26 which is connected to the outlet 3 of the variable displacement pump 1 via a pressure line 16. At this inlet 26, pressure is therefore applied by pressure fluid from the variable displacement pump 1. A servo connection 27 of the housing 11 is linked to the servo cylinder 5 via the pressure line 17. An inlet 18 of the housing 11 is linked to the tank 19 via the tank line 10.

The servo cylinder 5 is connected to the control device 20 via the pressure line 17 and is supplied with pressure fluid by it. The pressure fluid acts on the servo piston 4 and shifts this against the force of a return spring 32. Shifting of the servo piston 4 adjusts the variable displacement pump 1 as required via the activation link 33. This adjustment might consist of a change in the deflection angle of a swash plate, for example. Alternatively, the control device 20 can reduce the pressure in the servo cylinder 5 in that shifting the control piston 6 creates a link between the servo connection 27, which now acts as an inlet, and the outlet 18 to the tank 19. This reduces the pressure in the servo cylinder 5, resulting in the servo piston 4 being shifted under the impact of the return spring 32 in such a way that the servo force acting on the adjustment element of the variable displacement pump 1 is reduced and the latter is deflected further, leading to an increase in supply pressure.

Figure 4:
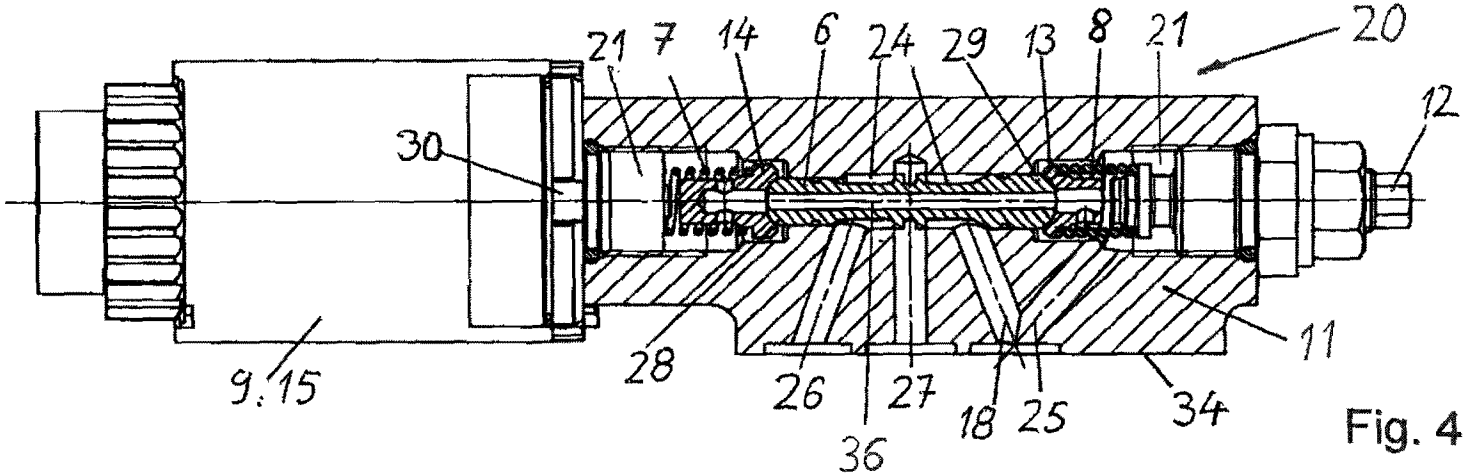
FIG. 4 A partial longitudinal cross-section of a control device according to the invention of the type shown in FIG. 2.
Figure 5:
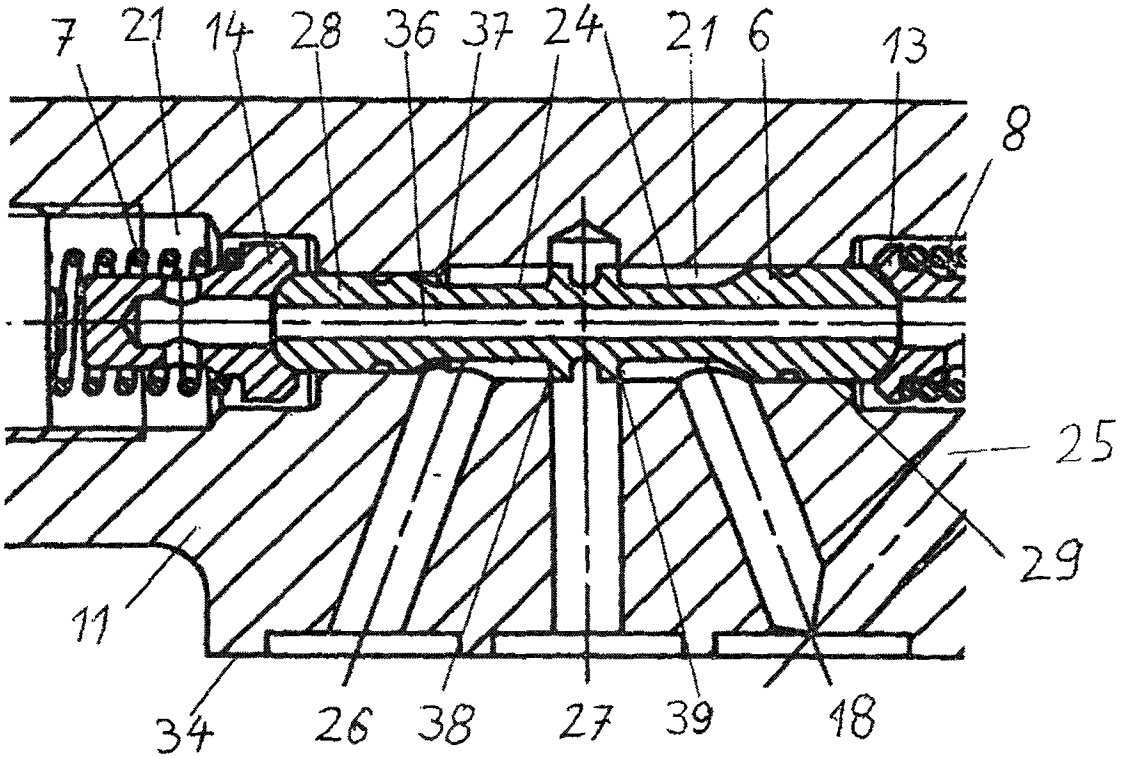
FIG. 5 A detailed view of the central section of a control unit according to FIG. 4.

The control piston 6 is guided in a stepped longitudinal or through-hole 21 of the housing 11 (see FIGS. 3, 4 and 5) and comprises at least two circumferential grooves 24 which form control edges 38, 39 (see FIG. 5). The respective positions of the control edges 38 in relation to the various inlets and outlets (18, 26, 27) determine the inflow and outflow of pressure fluid in relation to the servo cylinder 6. Via the actuator 9, which by way of an example here takes the form of a solenoid 15 with a movable armature designed as a tappet 30, a force which can be externally specified is exerted on the control piston 6 such that the latter changes its position. In the case of it being a solenoid 15, the actuator 9 draws its power supply from a control unit not shown here, the level of which can be set by means of an entry device which is not shown here either. This entry device can be operated manually in analog or digital form, for example, or respond to signals supplied by sensors. What is more, the actuator can also be operated mechanically, hydraulically or pneumatically without deviating from the inventive concept. These details are familiar to the person skilled in the art so they will not be expanded on here.

When the actuator 9 is at zero power, a state of balance is created at the control piston 6, thereby setting a predefined position of the control edges 38 and 39 by means of which the interaction between the other forces is fixed. These forces are determined by the prevailing output pressure of the variable displacement pump 1 at the inlet 26 and the interplay of the springs 7 and 8, which act against each other. By setting the adjustable spring 7, it is possible to specify the starting position at which the actuator 9 is powerless, for example. This means that the control edges 38 and 39 of the control piston 6 determine a defined pressure in the servo cylinder 5 which results in the corresponding output pressure at the outlet 3 of the variable displacement pump 1. If the control device according to the invention is to be used for the controlled increase of the displacement volume of the variable displacement pump 1, this output pressure is relatively low (see FIG. 6) and defines the idle pressure of the variable displacement pump 1. If the control device according to the invention is to be used for the controlled reduction of the displacement volume of the variable displacement pump 1, this output pressure is relatively high (see FIG. 7) and defines the maximum pressure of the variable displacement pump 1.

Figure 2:
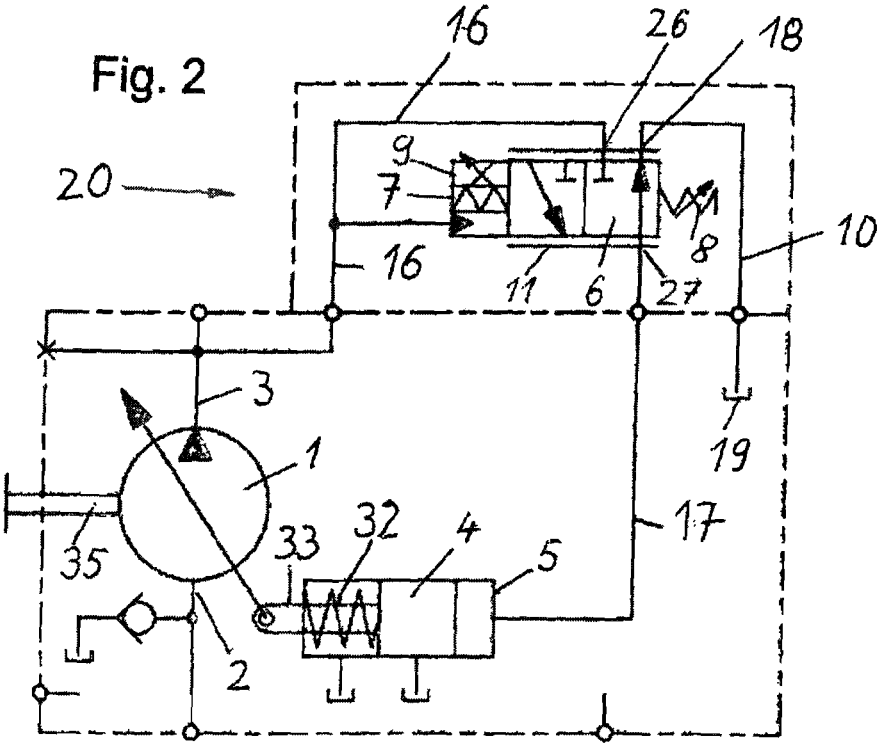
FIG. 2 A variable displacement pump with another type of control device according to the invention in diagrammatic form.
Figure 3:
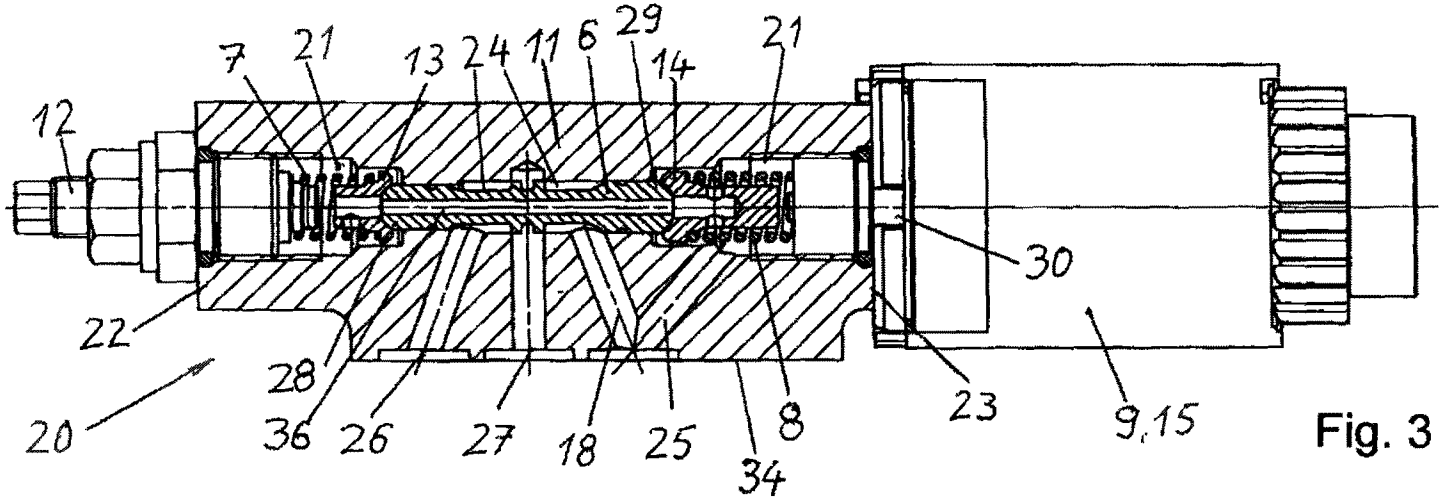
FIG. 3 A partial longitudinal cross-section of a control device according to the invention of the type shown in FIG. 1.

If the control device is of the construction type as shown in FIGS. 1 and 3, the actuator 9 is configured as pressure-generating, for example, and engages at the second end 28 of the control piston 6, which is positioned adjacent to the outlet 18 and the servo connection 27. If an electric current is applied to the actuator 9, here configured as a solenoid 15, for example, an additional force acts on the second end 29 of the control piston 6 via a tappet 30 which shifts the control piston out of its starting position. The starting position of the control piston 6 for the preferred embodiments shown in FIGS. 1 and 3 with an actuator 9 that generates a compressive force is therefore the position of the control piston 6 when shifted to maximum extent towards the outlet side, where the actuator 9 is also positioned. In this starting position, the control edge 28 therefore opens the hydraulic link between the outlet 26 and the servo connection 27 (cf. FIG. 5) so that the high pressure of the variable displacement pump 1 is passed onto the servo cylinder 5, causing pressure fluid to apply pressure to the servo piston 4. If the hydraulic force of the servo piston 6 is greater than the force of the servo piston return spring 32, the adjustment element of the variable displacement pump 1 is shifted in the direction of decreased deflection and the displacement volume of the variable displacement pump 1 is reduced until a balance of forces sets in at the servo piston 4. In the starting position shown in FIG. 2 and with an actuator 9 generating a compressive force, the variable displacement pump 1 is at a minimum flow rate corresponding to its drive speed.

If a compressive force is now exerted on the control piston 4 via the actuator 9, the control piston 4 is shifted towards the inlet side, causing the control edge 38 to close the hydraulic link between the servo connection 27 and the inlet 26 as the compressive force exerted by the actuator 9 is increased, and, as the compressive force is increased, causing the control edge 39 facing the outlet side to open the hydraulic link to the outlet 18, by means of which the pressure in the servo cylinder 5 to the tank 19 can be relieved. The servo piston return spring 32 now shifts the servo piston 4 in the direction of the zero pressure position, thereby increasing the adjustment of the variable displacement pump 1 and increasing the displacement volume, until the pressure level in the servo cylinder is the same as in the tank 19. The variable displacement pump 1 then reaches its maximum flow rate in accordance with its drive speed.

In this way it is possible, according to the invention, to continuously adjust and regulate the output pressure of the variable displacement pump 1 from a low level, which can be set via the setting screw 12 at idle, to a higher level by specifying the force applied by the actuator 9.

FIG. 2 shows a variable displacement pump 1 with another type of the control device 20 according to the invention in diagrammatic form. In this and in the subsequent figures, analog components bear the same reference numerals as those in FIG. 1.

The construction type shown in FIGS. 2 and 4 only differs from that of FIGS. 1 and 3 in that the actuator 9 is positioned on the side of the first end 28 of the control piston 6, i.e. on the inlet side of the control piston, while the now adjustable spring 8 is positioned at the second end 29, i.e. on the outlet side of the control piston. Consequently, the setting screw 12 is positioned on the outlet side. The other elements remain unchanged. As a result of this construction type, in which the actuator 9 is positioned adjacent to the inlet 26 of the housing 11, which in turns generates a compressive force, the function of the control device is altered. When the actuator 9 is inactive, the balance of the forces acting on the control piston 6 is set in such a way that a minimum pressure is applied to the servo piston 4. This is achieved in that the spring force of the first spring 7 is greater than the counterforce of the second spring 8 that is adjustable by the setting screw 12, the second spring 8 engaging on the opposite side of the control piston 6 like the actuator 9. When the actuator 9 is inactive and powerless, the control piston 6 is shifted to the maximum extent to the inlet side and the control edge 39 opens the hydraulic link of the servo connection 27 with the tank outlet 18, causing the pressure level of the servo cylinder to be the same as that of the tank 19, i.e. virtually pressure-free or equal to the pressure level of the housing. In this way, the variable displacement pump 1 is set to the structurally defined maximum displacement volume, since a variable displacement pump is assumed that is set to maximum deflection when the servo piston does not exert any force on the adjustment element of the variable displacement pump 1. The variable displacement pump 1 therefore operates in starting position at a high output pressure which, as explained above, acts on the control piston 6 and codetermines the relative position of the control piston 6 in the housing 11. In the preferred embodiment shown in FIGS. 2 and 4 with an actuator 9 capable of generating a compressive force, the hydraulic force exerted by the supply pressure of the variable displacement pump 1 on the control piston plus the spring force of the first spring 7, is not sufficiently great, when the actuator 9 is inactive, to shift the control piston 6 from its maximum position on the inlet side without the help of actuator 9.

If the solenoid 15 of the actuator 9 is now supplied with electric current, this changes the balance of forces at the control piston 6 and the control piston 6 is shifted from the previously occupied maximum position on the inlet side. In FIG. 2, this is therefore towards the right, since the actuator 9 exerts additional pressure on the first end 28 of the control piston. As a result, the position of the control edges 38, 39 (see FIG. 5) of the control cylinder 6 changes in relation to the through-channels 18, 26, 27 of the housing 11 with the results as described based on the preferred embodiment shown in FIGS. 1 and 3. The pressure in the servo cylinder 5 increases in line with the specification provided by the control unit 20, which leads to a reduction in pressure at the outlet 3 of the variable displacement pump 1 since there is an increase in the force of the servo piston 4 acting on the adjustment element of the variable displacement pump 1. This construction type of the adjustment device according to the invention therefore allows the output pressure at outlet 3 of the variable displacement pump 1 to be set in such a way that, assuming a high level of pressure at which the actuator 9 is inactive, the actuator 9 can be activated to set a lower pressure level in a controlled manner. As already mentioned, this happens without requiring a change in the rotational speed of the drive shaft 35.

FIG. 3 shows a partial longitudinal cross-section of a control device 20 according to the invention of the general construction type according to FIG. 1 in which the pressure at the outlet 3 of the variable displacement pump 1 can be set from a low level to a higher level. In this preferred embodiment, contrary to the depiction in FIG. 1, the spring 8 and the actuator 9, here configured as a solenoid that generates a compressive force, are arranged in series. This means that the actuator 9 engages via the spring 8 at the control piston 6, whereby the tappet of the actuator 9 is in contact with one end of the spring 8. In a parallel arrangement of the spring 8 and the actuator 9 not shown here, the tappet 30 of the actuator 9 immediately adjoins the adjacent end 28, 29 of the control piston 6, for example, without touching the spring 8. For this purpose, the pin-shaped tappet 30 passes through the inside of the spring 8 configured to exert pressure, for example, or it engages at the guide 14 of the spring 8.

The control device 20 comprises a housing 11 through which a bore 21 passes from a first end face 22 to a second end face 23. The bore 21 is stepped, comprising a central section with a smaller diameter flanked on both sides by sections with a larger diameter. The control piston 6 slides in the central section. This central section is itself stepped in such a way that a first end 28 of the control piston 6 runs through a section with a smaller diameter while the adjacent section has a somewhat larger diameter. The boundary between the two sections is located, for example, in the area of the opening of the outlet 26 in the central sections of the bore 21 and forms a step 37 or control edge 38 (see FIG. 5). The control piston 6 is adapted to the shape of the central section of the bore 21 in such a way that its first end section 28 has a smaller diameter than the adjacent section up to the second end of the control piston 6. It should be emphasized that the thinner end of the control piston 6 with its stepped configuration is always located near the opening of the outlet 26 for pressure fluid in the central section of the bore 21. The control piston 6 comprises two circumferential grooves 24 whose lateral limits form control edges 38, 39. It also has a continuous through bore or longitudinal bore 36 passing through it which serves to balance the pressure level between its two end sections 28, 29. At the first end 28 of the control piston, on the left in FIG. 2, the spring 7 configured as a compression spring engages via the guide 13. The other end of the spring 7 rests on the setting screw 12 which can be adjusted in its longitudinal direction via a thread, thereby allowing the force exerted by the spring 7 on the control cylinder 6 to be adjusted. At the opposite, second end 28 of the control piston 6, a spring 8 is also positioned whose force is transmitted via the guide 14 onto the control piston 6. The end of the control piston 6 pointing away from the spring 8 rests on the tappet 30 of the actuator 9, configured here as a solenoid 15. In this way, the spring 8 and the actuator 9 are arranged in series.

Several channels 18, 25, 26, 27 pass through the housing 11 of the control device 20, which are, for example, directed towards the central bore 21 starting from a base area 34 of the housing 11. The channels 18, 25, 26, 27 cross the bore 21, thereby forming the inlet 26 for pressure fluid from the variable displacement pump 1, the servo connection 27 to the servo cylinder 5 and the outlet 18 to the tank 19. When the control edges 38, 39 of the control piston 6 are appropriately positioned, the two channels 18 and 25 serve to drain pressure fluid from the servo connection 27 via the groove 24 in the control piston 6 to the outlet 18 and therefore to the tank 19.

The channels 18, 25, 26, 27 are hydraulically connected to the lines 10, 16, 17 for the pressure fluid, as shown in FIG. 1. When the control piston 6 is shifted, its control edges 38, 39 defined by the grooves 24 pass over the channel 27 that discharges into the bore 21, thereby opening the connection between the channels 18 and 27 as well as 26 and 27 in a defined manner or else blocking them completely. In this way it is possible to control the pressure acting on the servo control unit, i.e. the servo control piston 6.

If one considers the preferred embodiment in FIG. 4 once again, the control piston 6 is moved to the right, away from the actuator 9, under the balance of forces of the springs 7, 8 and the output pressure of the variable displacement pump 1; here the control piston resumes its starting position in which the variable displacement pump is set to minimum output. This starting position, which can be set by means of the setting screw 12 at the spring 7, causes a defined pressure in the servo cylinder 5 since the operating pressure of the variable displacement pump 1 is directed onto the servo piston 6, thereby moving the variable displacement pump 1 into a minimally deflected position, which results in a defined low pressure at the outlet 3 of the variable displacement pump 1 that is nonetheless sufficient to apply a maximum servo force to the servo piston.

If the solenoid 15 of the actuator 9 in FIG. 4 is supplied with electric current, its tappet 30 moves/pulls the control piston 6 to the left, if the actuator 9 is configured so as to exert a tractive force. Due to this additional tractive force applied to the control piston, which supports the spring force of spring 8, the position of the control edges 38, 39 of the control piston 6 changes in relation to the opening of the channel 27, which blocks the hydraulic connection between the outlet 26 and the servo cylinder 5 as the tractive force of the actuator 9 increases. As a result, the pressure on the servo piston 6 is reduced, changing the position of the servo piston 4 because the servo force decreases, increasing the flow rate of the variable displacement pump 1.

Figure 6:
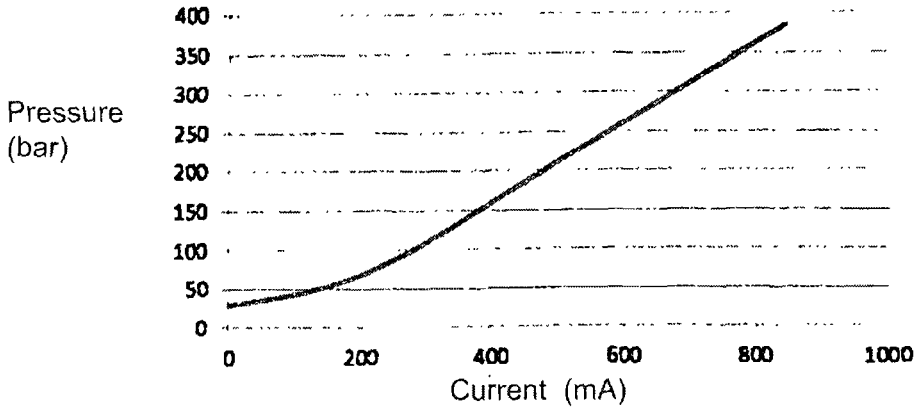
FIG. 6 An exemplary current/pressure diagram for the controlled increase of supply pressure using the control device according to the invention.

The increased pressure at the outlet of the variable displacement pump 1 is transferred to the inlet 26 of the control unit 20 via the line 16 and acts on the control piston 6 via the stepped diameters of the end sections 28, 29 of the control piston 6. This produces a new balance of forces at the control piston 6 which results in the automatic setting of an increased but constant pressure level at the outlet 3 of the variable displacement pump 1. This pressure level can therefore be set via the electric current at the solenoid 15 or generally by controlling the actuator 9, whether mechanically, pneumatically, hydraulically or similar, and the pressure level is regulated automatically by the control device according to the invention. FIG. 6 shows an exemplary current/pressure diagram for the construction type of the control device 20 according to FIGS. 1 and 3, where the actuator 9 is configured as a control element which generates a compressive force.

FIG. 4 shows a partial longitudinal cross-section of a control device 20 according to the invention, of the general construction type according to FIG. 2, in which the pressure at the outlet 3 of the variable displacement pump 1 can be set from a high level to a lower level. In this preferred embodiment, however, contrary to the depiction in FIG. 2, the spring 7 and the actuator 9, here configured as a solenoid 15, are arranged in series. This means that the actuator 9 engages the control piston 6 via the spring 7. As previously in FIG. 3, FIG. 4 shows a state in which the control piston 6 assumes a position where the control edges 38, 39 (see FIG. 5) block the hydraulic link to the servo connection 27 as well as to the inlet 26 and the outlet 18. In this construction type, the starting position of the control piston 6 is shifted further to the right than in FIGS. 3 and 4 when the actuator 9 is inactive.

Figure 7:
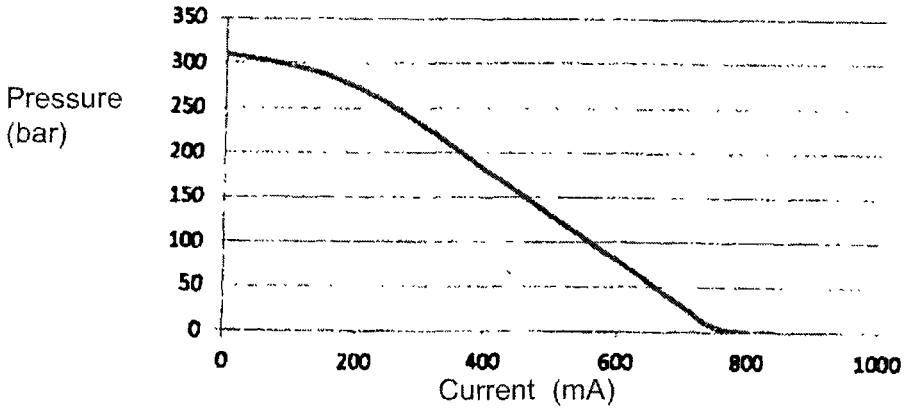
FIG. 7 An exemplary current/pressure diagram for the controlled increase of supply pressure using the control device according to the invention.

The arrangement according to FIG. 4 differs from that of FIG. 3 in that the actuator 9 and the first spring 7 are allocated to the first end 28 of the control piston 6 while the second spring 8, now adjustable via the setting screw 12, acts on the second end 29 of the control piston 6. Otherwise the components in FIG. 4 are exactly the same as those in FIG. 3. The mode of action of this arrangement differs from that according to FIG. 3 in that when the actuator 9 is not activated, the control piston 6 is shifted into its starting position (towards the left in FIG. 4) in such a way that the full, maximum output pressure of variable displacement pump 1 is applied at the inlet 26 of the control piston 6. When the actuator 9 is activated and the control piston 6 is shifted to the right, the pressure on the servo piston 6 is increased such that the variable displacement pump is reduced in its deflection and therefore in its flow rate, thereby diminishing the pressure at the outlet 3. In the preferred embodiment shown in FIG. 4, therefore the output pressure of the variable displacement pump 1 can be regulated from a high initial level to lower levels by means of the actuator 9. FIG. 7 shows an exemplary current/pressure diagram for the construction type of the control device 20 according to FIGS. 2 and 4.

FIG. 5 shows a detailed view of the central section of the housing 11 of the control device 20 according to FIG. 4. Here the reference numerals apply in the same way as in FIGS. 1 to 4. The stepped central section of the bore 21 with the step 37 is to be emphasized, as are the varying diameters of the two ends 28, 29 of the control piston 6. The step 37 accommodates the different diameters of the control piston 6. This difference causes the pressure acting via the inlet 26 on the control piston 6 at the outlet 3 of the variable displacement pump 1 to exert a force on the control piston 6. In the event of an arrangement according to FIG. 5 and in all other preferred embodiments, this force is always directed towards the thicker, second end 29 of the control piston 6, i.e. towards the right-hand side in the examples shown in the figures. The pressure at the outlet 3 of the variable displacement pump 1 has a direct impact on the balance of forces acting on the control piston 6.

FIG. 6 shows an exemplary current/pressure diagram of the control device according to FIGS. 1 to 5 in which a controlled reduction of supply pressure is effected by the control device according to the invention. Here the actuator 9 is configured in general form as a solenoid which causes increasing deflection of the tappet 30 positioned at the armature. A low initial pressure level can be seen with the actuator 9 inactive, i.e. the starting position of the control piston 6. The starting position of the control piston 6 in the diagram according to FIG. 6 is in its position of maximum deflection towards the outlet side in which the control edge 39 entirely closes the opening of the outlet 18, causing the pressure in the servo cylinder 5 to be equal to that of the variable displacement pump 1, thereby exerting a maximum servo force on the adjustment element, for example a swash plate, the variable displacement pump 1 being in a minimally deflected state. As the electric current to the actuator 9 is increased, the control piston 6 is shifted towards the inlet side, whereby the closing of the inlet 26 and simultaneous opening of the outlet 18 lowers the pressure in the servo cylinder 5 as well as the force of the servo cylinder 4 acting on the adjustment element, such that the servo adjustment allows the adjustment element to be deflected, increasing the supply pressure of variable displacement pump 1. Across a wide range, the increase in supply pressure is preferably linear and proportional to the actuator force.

FIG. 7 shows an exemplary current/pressure diagram for the construction type of the control device according to FIGS. 1 to 5 in which a controlled reduction of supply pressure is effected by the control device according to the invention. Here the supply pressure of the variable displacement pump 1 is at a maximum level in its starting position when the actuator 9 is inactive, and this pressure is continuously reduced as the electric current applied to the actuator 9 is increased. In the starting position here, the control piston is shifted to the inlet side to maximum extent with the servo control virtually powerless and the variable displacement pump 1 deflected to maximum flow rate as is inherent to its design. Controlled pressure reduction by means of controlled application of electric current to the actuator 9 can extend to the value "zero", at which the variable displacement pump 1 does not pump any pressure fluid. However, pumping is recommenced as soon as the electric current falls below the relevant boundary value.

What is claimed is:

1. A control device (20) for a hydraulic variable displacement pump (1) which is operated in an open hydraulic circuit and which is adjustable by a servo piston (4) configured to shift inside a servo cylinder (5), to which servo piston (4) pressure is applied by pressurized pressure fluid via the control device (20), the control device (20) comprising:

a housing (11) of a control piston (6), an inlet (26) for the connection of a high pressure line of the variable displacement pump (1), an outlet (18) which is configured to connect to a tank (19) and a servo connection (27) configured to link to the servo cylinder (5), the control piston (6) having a first control edge (38) and a second control edge (39) and being mounted in the housing (11) so that the control piston (6) shifts longitudinally from a first end to a second end, whereby the control piston (6) is configured to create a connection between the inlet (26) and the servo connection (27) via the first control edge (38) and the control piston is configured to create a connection between the servo connection (27) and the outlet (18) via the second control edge (3), the control piston (6) is preloaded by a first spring (7) at the first end (28) which is adjacent to the outlet (26), at the second end (29) of the control piston (6) adjacent to the outlet (18) a second spring (8) engages the control piston (6), which counteracts a hydraulic force and the preload of the first spring (7), a power-adjustable actuator (9) at one of the two ends (28 or 29) of the control piston (6) that engages the control piston (6) by a tractive or a compressive force transmitted to another of the two ends (28 or 29) in parallel with the respective spring (7 or 8) of the control piston (6) such that the force of the actuator (9) is applied to the control piston (6) toward the another of the two ends (28 or 29), whereby pressure can only be applied to the control piston (6) with the pressure fluid under pressure from the variable displacement pump (1) to generate the hydraulic force toward the direction of the another of the two ends (28 or 29) of the control piston (6), and a spring guide (13, 14) configured to provide fluid communication between a longitudinal bore (36) of the control piston (6) and a first spring chamber (21) in one position of the control piston (6).

2. The control device (20) for the hydraulic variable adjustment pump (1) according to claim 1, characterized in that the control piston (6) is stepped and the pressurized pressure fluid of the variable displacement pump (1) acts on two diameters of differing sizes, whereby the diameter acting in the direction of the outlet (18) is larger.

3. The control device (20) for the hydraulic variable displacement pump (1) according to claim 1, characterized in that the actuator (9) is an electric solenoid to which electric current is applied at adjustable levels by an electronic control unit (31).

4. The control device (20) for the hydraulic variable displacement pump (1) according to claim 1, characterized in that the spring force of the first spring (7) or second spring (8) is set by a setting device (12).

5. The control device (20) for the hydraulic variable displacement pump (1) according to claim 1, characterized in that the actuator (9) and the spring (7 or 8) positioned at the one of the two ends of the control piston (6) are arranged in series.

6. The control device (20) for the hydraulic variable displacement pump (1) according to claim 1, the spring guide (13, 14) is configured to transmit the spring force to the one end of the two ends (28 or 29) of the control piston (6).

7. The control device (20) for the hydraulic variable displacement pump (1) according to claim 1, characterized in the first spring (7) is mounted in the first spring chamber (21) and the second spring (8) is mounted in a second spring chamber (21), each of the first spring chamber (21) and the second spring chamber (21) are respectively configured so as to be adjacent to a respective one of the two ends of the control piston (6) and are connected to each other via the longitudinal bore (36) in the control piston (6).

8. The control device (20) for the hydraulic variable displacement pump (1) according to claim 7, characterized in that one of the two spring chambers (21) is connected to the outlet (18) by means of a channel (25) in the housing (11).

9. The control device (20) for the hydraulic variable displacement pump (1) according to claim 1, wherein the pressurized pressure fluid from the variable displacement pump (1) is applied to the servo piston (4) via the control device (20)) in order to set a supply pressure.

10. The control device (20) for the hydraulic variable displacement pump (1) according to claim 9, characterized in that the variable displacement pump (1) is configured as an axial piston machine of the swash plate or bent axis design.

11. The control device (20) for the hydraulic variable displacement pump (1) according to claim 1, further comprising the control piston (6) having two circumferential grooves (24) whose longitudinal limits form the first control edge (38) and the second control edge (39) respectively.

12. The control device (20) for the hydraulic variable displacement pump (1) according to claim 1, wherein the longitudinal bore (36) passes through an axial length of the control piston.

13. The control device (20) for the hydraulic variable displacement pump (1) according to claim 12, wherein the longitudinal bore (36) is configured to balance pressure between the first end (28) and the second end (29) of the piston (6).

14. The control device (20) for the hydraulic variable displacement pump (1) according to claim 1, characterized in that the actuator (9) is positioned on the opposite side of the pressure applied by the pressurized pressure fluid.

15. The control device (20) for the hydraulic variable displacement pump (1) according to claim 1, characterized in the actuator (9) having a tappet (30) that passes through the adjacent one of the two springs (7 or 8).

16. The control device (20) for the hydraulic variable displacement pump (1) according to claim 15, characterized in that the tappet (30) is configured to exert the force of the actuator at the spring guide (14).

17. The control device (20) for the hydraulic variable displacement pump (1) according to claim 1 wherein the force of the adjacent one of the two springs (7 or 8) is applied independently to the control piston (6) of the force of the actuator (9) throughout actuation of the actuator (9).

18. A control device (20) for a hydraulic variable displacement pump (1) which is operated in an open hydraulic circuit and which is adjustable by means of a servo piston (4) configured to shift inside a servo cylinder (5), to which servo piston (4) pressure is applied by means of pressurized pressure fluid via the control device (20), the control device (20) comprising:

a housing (11) of a control piston (6), an inlet (26) for the connection of a high pressure line of the variable displacement pump (1), an outlet (18) which is configured to connect to a tank (19) and a servo connection (27) configured to link to the servo cylinder (5), the control piston (6) having a first control edge (38) and a second control edge (39), whereby the control piston (6) is configured to create a connection between the inlet (26) and the servo connection (27) via the first control edge (38) and the control piston is configured to create a connection between the servo connection (27) and the outlet (18) via the second control edge (3), the control piston (6) is preloaded by a first spring (7) at a proximal end (28) which is adjacent to the outlet (26), at a distal end (29) of the control piston (6) adjacent to the outlet (18) a second spring (8) engages which counteracts a hydraulic force and the preload of the first spring (7), a power-adjustable actuator (9) at the proximal end (28) of the control piston (6) engages with a tractive or a compressive force is transmitted to the distal end (29) in parallel with the first spring (7) of the control piston (6) such that the force of the actuator (9) is applied to the control piston (6) toward the distal end (29) independently of the force of the first spring (7) towards the respective the distal end (29), whereby pressure can only be applied to the control piston (6) with the pressure fluid under pressure from the variable displacement pump (1) to generate the hydraulic force in the direction of the distal end (29) of the control piston (6), a spring guide (13, 14) configured to provide fluid communication between a longitudinal bore (36) of the control piston (6) and a spring chamber (21) in one position of the control piston (6).

19. A control device (20) for a hydraulic variable displacement pump (1) which is operated in an open hydraulic circuit and which is adjustable by a servo piston (4) configured to shift inside a servo cylinder (5), to which servo piston (4) pressure is applied by pressurized pressure fluid via the control device (20), the control device (20) comprising:

a housing (11) of a control piston (6), an inlet (26) for the connection of a high pressure line of the variable displacement pump (1), an outlet (18) which is configured to connect to a tank (19) and a servo connection (27) configured to link to the servo cylinder (5), the control piston (6) having a first control edge (38) and a second control edge (39), whereby the control piston (6) is configured to create a connection between the inlet (26) and the servo connection (27) via the first control edge (38) and the control piston is configured to create a connection between the servo connection (27) and the outlet (18) via the second control edge (3), the control piston (6) is preloaded by a second spring (8) at a distal end (29) which is adjacent to the inlet (28), at a proximal end (28) of the control piston (6) adjacent to the outlet (26) a first spring (7) engages which counteracts a hydraulic force and the preload of the second spring (8), a power-adjustable actuator (9) at the distal end (29) of the control piston (6) engages with a tractive or a compressive force is transmitted to the proximal end (28) in parallel with the second spring (8) of the control piston (6) such that the force of the actuator (9) is applied to the control piston (6) toward the proximal end (28) independently of the force of the second spring (8) towards the respective proximal end (28), whereby pressure can only be applied to the control piston (6) with the pressure fluid under pressure from the variable displacement pump (1) to generate the hydraulic force in the direction of the proximal end (28) of the control piston (6), a spring guide (13, 14) configured to provide fluid communication between a longitudinal bore (36) of the control piston (6) and a spring chamber (21) in one position of the control piston (6).

* * * * *